US011515635B2

(12) United States Patent
Ting et al.

(10) Patent No.: US 11,515,635 B2
(45) Date of Patent: Nov. 29, 2022

(54) ANTENNA STRUCTURE AND ELECTRONIC DEVICE

(71) Applicants: Inventec (Pudong) Technology Corporation, Shanghai (CN); INVENTEC CORPORATION, Taipei (TW)

(72) Inventors: Ssu-Han Ting, Taipei (TW); Yu-Shu Tai, Taipei (TW); Chun-Yi Wang, Taipei (TW); Wei-Chen Lai, Taipei (TW)

(73) Assignees: Inventec (Pudong) Technology Corporation, Shanghai (CN); INVENTEC CORPORATION, Taipei (TW)

( * ) Notice: Subject to any disclaimer, the term of this patent is extended or adjusted under 35 U.S.C. 154(b) by 39 days.

(21) Appl. No.: 17/202,374

(22) Filed: Mar. 16, 2021

(65) Prior Publication Data

US 2022/0140489 A1 May 5, 2022

(30) Foreign Application Priority Data

Nov. 3, 2020 (CN) ..... 202011210853.X

(51) Int. Cl.

| | |
|---|---|
| ***H01Q 1/24*** | (2006.01) |
| ***H01Q 13/08*** | (2006.01) |
| ***H01Q 9/04*** | (2006.01) |
| ***H01Q 9/06*** | (2006.01) |

(52) U.S. Cl.

CPC ..... *H01Q 13/085* (2013.01); *H01Q 9/0414* (2013.01); *H01Q 9/0421* (2013.01); *H01Q 9/065* (2013.01)

(58) Field of Classification Search

CPC .. H01Q 13/085; H01Q 9/0414; H01Q 9/0421; H01Q 9/065

See application file for complete search history.

(56) References Cited

U.S. PATENT DOCUMENTS

| | | | | |
|---|---|---|---|---|
| 2004/0041734 | A1* | 3/2004 | Shiotsu | H01Q 9/42 343/702 |
| 2007/0229366 | A1* | 10/2007 | Kim | H01Q 9/42 343/846 |
| 2008/0150821 | A1* | 6/2008 | Koch | H01Q 21/065 343/776 |
| 2015/0009086 | A1* | 1/2015 | Yeh | H01Q 1/243 343/858 |

FOREIGN PATENT DOCUMENTS

| | | | |
|---|---|---|---|
| CN | 205302092 U | * | 6/2016 |
| CN | 210468068 U | | 5/2020 |
| CN | 211743382 U | | 10/2020 |
| TW | 523709 B | | 3/2003 |
| TW | I345856 B | | 7/2011 |

* cited by examiner

*Primary Examiner* — Dieu Hien T Duong

(74) *Attorney, Agent, or Firm* — CKC & Partners Co., LLC

(57) ABSTRACT

An antenna structure includes an antenna radiator, a microstrip line, a flexible board, and a coaxial cable. The antenna radiator is used to receive and transmit wireless signals. The wireless signals include radio frequency signals. The microstrip line is coupled to the antenna radiator and is used to transmit the radio frequency signals. The flexible board is coupled to the microstrip line and is used to transmit the radio frequency signals. The coaxial cable is coupled to the flexible board and is used to transmit the radio frequency signals to a processor.

8 Claims, 2 Drawing Sheets

ANTENNA STRUCTURE AND ELECTRONIC DEVICE

CROSS-REFERENCE TO RELATED APPLICATION

This application claims priority to China Application Serial Number 202011210853.X, filed Nov. 3, 2020, which is herein incorporated by reference in its entirety.

BACKGROUND

Field of Invention

The present disclosure relates to an antenna structure and an electronic device. More particularly, the present disclosure relates to an antenna structure and an electronic device having an aforementioned antenna structure.

Description of Related Art

Conventional technology uses a coaxial cable as a connector between an antenna and modules, but this design method will compress a design space of an antenna at a top side of a laptop so that cables cannot be routed behind a panel of a laptop. It should be noted that conventional electronic devices have limited internal space. If coaxial cables are routed behind a panel of a laptop, water ripples or fragments will be generated on a panel. Furthermore, cables must be routed behind a panel to a motherboard of a laptop. As a result, high frequency signals decrease as a length of cables increases.

For the foregoing reason, there is a need to provide some other antenna structures to solve the problems of the prior art.

SUMMARY

One aspect of the present disclosure provides antenna structure. The antenna structure includes an antenna radiator, a microstrip line, a flexible board, and a coaxial cable. The antenna radiator is configured to receive or transmit a wireless signal. The wireless signal includes a radio frequency signal. The microstrip line is coupled to the antenna radiator, and is configured to transmit the radio frequency signal. The flexible board is coupled to the microstrip line, and is configured to transmit the radio frequency signal. The coaxial cable is coupled to the flexible board, and is configured to transmit the radio frequency signal to a processor.

Another aspect of the present disclosure relates to an electronic device. The electronic device includes a panel. The panel includes a display area, a peripheral area, and an aforementioned antenna structure. The peripheral area is located outside the display area. The aforementioned antenna structure is disposed in the peripheral area. A flexible board of the antenna structure is extended through the display area, and the flexible board is coupled to a coaxial cable of the panel.

These and other aspects of the present disclosure will become apparent from the following description of the preferred embodiment taken in conjunction with the following drawings, although variations and modifications therein may be effected without departing from the spirit and scope of the novel concepts of the disclosure.

It is to be understood that both the foregoing general description and the following detailed description are by examples, and are intended to provide further explanation of the present disclosure as claimed.

BRIEF DESCRIPTION OF THE DRAWINGS

The invention can be more fully understood by reading the following detailed description of the embodiment, with reference made to the accompanying drawings as follows.

DETAILED DESCRIPTION

Figure 1:
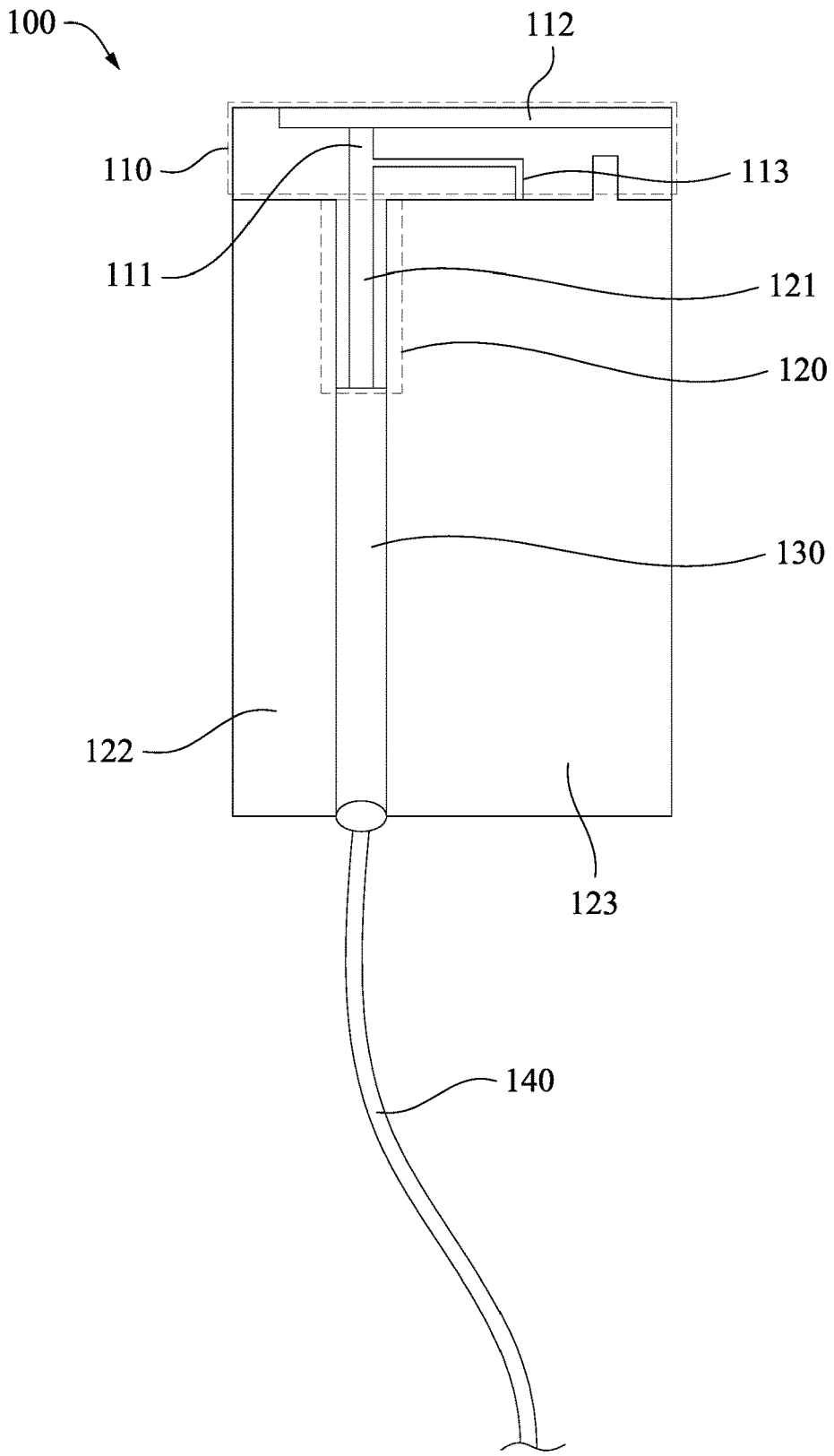
FIG. 1 depicts a schematic diagram of an antenna structure according to one embodiment of the present disclosure.

Reference will now be made in detail to the present embodiments of the invention, examples of which are illustrated in the accompanying drawings. Wherever possible, the same reference numbers are used in the drawings and the description to refer to the same or like parts.

FIG. 1 depicts a schematic diagram of an antenna structure according to one embodiment of the present disclosure. In some embodiments, as shown in FIG. 1, an antenna structure 100 includes an antenna radiator 110, a microstrip line 120, a flexible board 130, and a coaxial cable 140.

In some embodiments, please refer to FIG. 1, the antenna radiator 110 is configured to receive or transmit a wireless signal. The wireless signal includes a radio frequency signal. The microstrip line 120 is coupled to the antenna radiator 110, and is configured to transmit the radio frequency signal. The flexible board 130 is coupled to the microstrip line 120, and is configured to transmit the radio frequency signal. The coaxial cable 140 is coupled to the flexible board 130, and is configured to transmit the radio frequency signal to a processor (not shown in figure). The processor performs signal processing on the radio frequency signal.

In some embodiments, the antenna radiator 110 includes one of an L-antenna, an inverted-F antenna, a monopole antenna, and a coupled antenna. In some embodiments, the antenna radiator 110 includes one of 4G antenna and 5G antenna.

In some embodiments, the microstrip line 120 includes a coplanar waveguide (CPW). An impedance of a feed end of the microstrip line 120 includes 50 ohm (Ω). The microstrip line 120 includes a central line 121, a ground plane 122, and a ground plane 123. It should be noted that the impedance of the feed end of the microstrip line 120 of the present disclosure can be designed according to actual needs and not limited to aforementioned embodiments.

In some embodiments, the flexible board 130 includes Liquid Crystalline Polyester (LCP). It should be noted that LCP materials can maintain a constant dielectric constant in the high frequency band. In addition, a dielectric loss value of the LCP materials is very small. Even in a high frequency band of 110 GHz, a difference between a dielectric loss value of the LCP materials in a high frequency band and a dielectric loss value of the LCP materials in a normal band is very small so that the LCP materials are adapted for millimeter wave band. Furthermore, a thermal expansion of the LCP materials is small. Therefore, the LCP materials are adapted as packaging materials of wireless technology in a high frequency band.

In some embodiments, please refer to FIG. 1, the antenna radiator 110 and the microstrip line 120 are comprised of a conductive layer of a printed circuit board (PCB). It should be noted that the antenna radiator 110, the microstrip line 120, and the printed circuit board are integrated during a manufacturing process to make easy to connect in series and parallel with circuit components so as to save process costs and provide a variety of choices in circuit layout.

In some embodiments, the antenna radiator 110 includes a perpendicular portion 111, a horizontal portion 112, and a grounding 113. The perpendicular portion 111 is coupled to the microstrip line 120 at a feed end of the antenna structure 100. The ground plane 122 and the ground plane 123 are disposed on the both sides of the central line 121 symmetrically. The grounding 113 is coupled to one of the ground plane 122 and the ground plane 123.

In some embodiments, a thickness of the flexible board 130*s* about 0.35 time bigger than a thickness of the coaxial cable 140. It should be noted that the ratio of the thickness of the flexible board 130 and the thickness of the coaxial cable 140 of the present disclosure can be designed according to actual needs and not limited to aforementioned embodiments.

Figure 2:
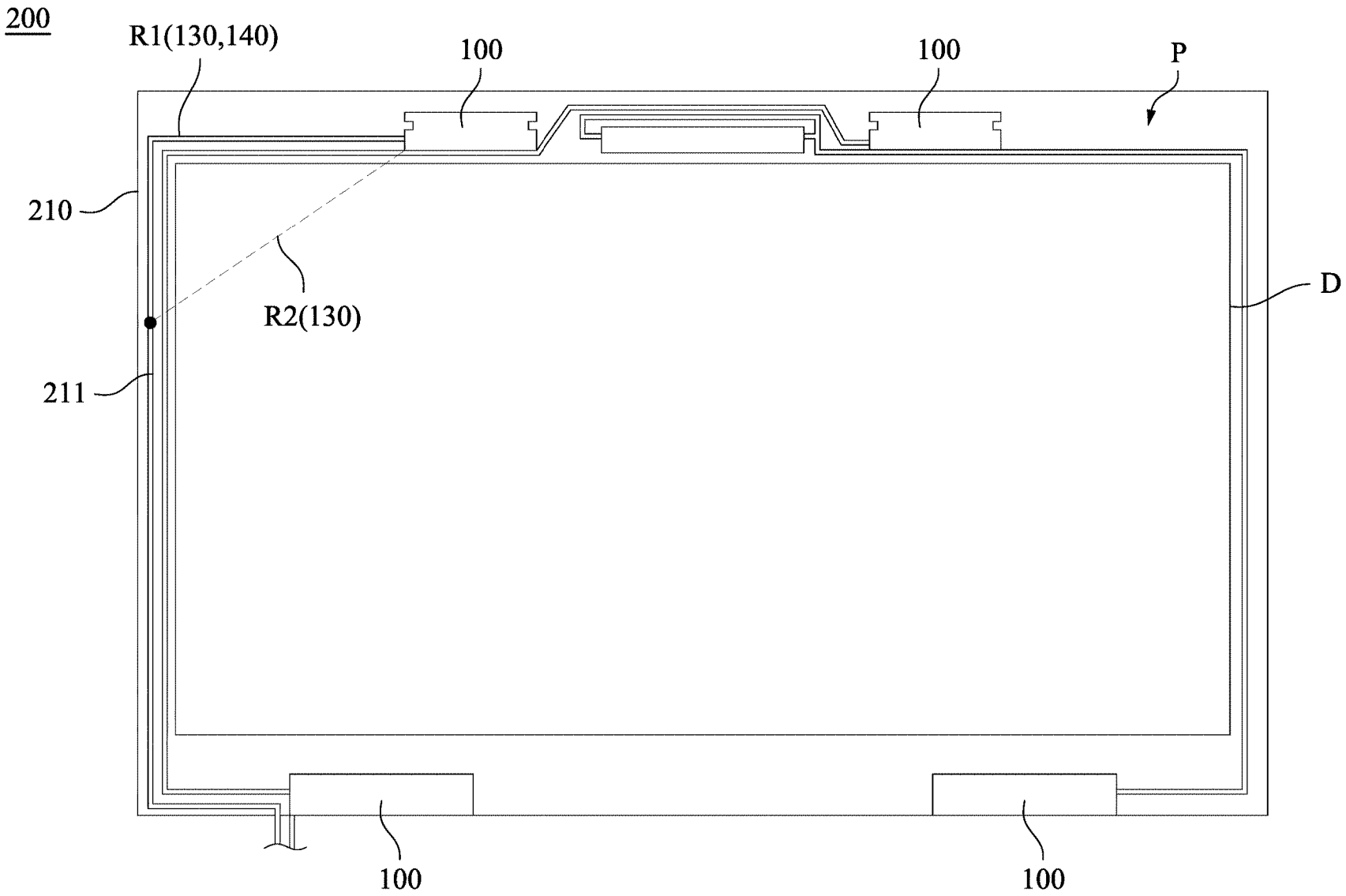
FIG. 2 depicts a schematic diagram of an electronic device having an antenna structure according to one embodiment of the present disclosure.

FIG. 2 depicts a schematic diagram of an electronic device having an antenna structure according to one embodiment of the present disclosure. In some embodiments, as shown in FIG. 2, an electronic device 200 includes a panel 210 and at least one antenna structure 100 shown in FIG. 1. In some embodiments, the panel 210 includes four antenna structures 100. A location of each of four antenna structures 100 can be located anywhere in a peripheral area P, and not limited to embodiments shown in FIG. 2. In some embodiments, a number of the antenna structure 100 is also not limited to embodiments shown in FIG. 2. In some embodiments, the electronic device 200 can be a laptop or a tablet computer.

In some embodiments, please refer to FIG. 2, the panel 210 includes a display area D, a peripheral area P, and at least one antenna structure 100 shown in FIG. 1. The peripheral area P is located outside the display area D. The at least one antenna structure 100 is disposed in the peripheral area P. The flexible board 130 of the antenna structure 100 is extended through the display area D, and the flexible board 130 is coupled to a coaxial cable 211 of the panel 210 in the peripheral area P.

For example, the flexible board 130 of the antenna structure 100 is coupled to the coaxial cable 211 in the peripheral area P along a route R2 in the display area D. In addition, cables along a route R1 include a combination of the flexible board 130 and the coaxial cable 140. The cables along the route R2 only include the flexible board 130. A path length of the cables along the route R2 is shorter than a path length of the cables along the route R1. A space height of the cables along the route R2 is also reduced about 65% height compared to a space height of the cables along the route R1. It should be noted that if the path length is in a XY plane, the space height is along Z axis. In some embodiments, a shape of the cables along the route R2 is not limited to a straight line and embodiments shown in FIG. 2.

Furthermore, the flexible board 130 of the antenna structure 100 is along the route R2 across the display area D to prevent the panel 210 from generating water ripples or fragments. The length of the route R2 is shorter than the length of the route R1 so that transmission loss is reduced as a length of the flexible board 130 decreases.

Based on the above embodiments, the present disclosure provides an antenna structure and an electronic device having an aforementioned antenna structure so as to improve a design space of an antenna structure, and reduce a length of cables so that an antenna maintains performance in a high frequency.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims.

What is claimed is:

1. An antenna structure, comprising:

an antenna radiator, configured to receive or transmit a wireless signal, wherein the wireless signal comprises a radio frequency signal;

a microstrip line, coupled to the antenna radiator, and configured to transmit the radio frequency signal;

a flexible board, coupled to the microstrip line, and configured to transmit the radio frequency signal, wherein the flexible board comprises liquid crystalline polyester; and a coaxial cable, coupled to the flexible board, and configured to transmit the radio frequency signal to a processor, wherein a thickness of the flexible board is about 0.35 time bigger than a thickness of the coaxial cable.

2. The antenna structure of claim 1, wherein the microstrip line comprises a coplanar waveguide.

3. The antenna structure of claim 2, wherein an impedance of the microstrip line comprises 50 ohm (Ω).

4. The antenna structure of claim 3, wherein the antenna radiator and the microstrip line comprise a conductive layer of a printed circuit board.

5. The antenna structure of claim 1, wherein the antenna radiator comprises a perpendicular portion, a horizontal portion, and a grounding, wherein the microstrip line comprises a central line and two ground planes, wherein the perpendicular portion is coupled to the microstrip line at a feed end of the antenna structure, the two ground planes are disposed at both sides of the central line symmetrically, and the grounding is coupled to one of the two ground planes.

6. The antenna structure of claim 1, wherein the antenna radiator comprises one of 4G antenna and 5G antenna.

7. The antenna structure of claim 1, wherein the antenna radiator comprises one of an L-antenna, an inverted-F antenna, a monopole antenna, and a coupled antenna.

8. An electronic device, comprising:

a panel, comprising:

a display area;

a peripheral area, located outside the display area; and at least one antenna structure of claim 1, disposed in the peripheral area, wherein the flexible board of the antenna structure is extended through the display area, and the flexible board is coupled to a coaxial cable of the panel.

* * * * *